US010954870B2

(12) United States Patent
Agnus et al.

(10) Patent No.: US 10,954,870 B2
(45) Date of Patent: Mar. 23, 2021

(54) DETECTION OF THE DIRECTION OF ROTATION OF A VEHICLE ENGINE

(71) Applicants: CONTINENTAL AUTOMOTIVE FRANCE, Toulouse (FR); CONTINENTAL AUTOMOTIVE GmbH, Hannover (DE)

(72) Inventors: Yves Agnus, Toulouse (FR); Julien Lefevre, Tournefeuill (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/754,482

(22) PCT Filed: Oct. 8, 2018

(86) PCT No.: PCT/FR2018/052471

§ 371 (c)(1),
(2) Date: Apr. 8, 2020

(87) PCT Pub. No.: WO2019/073153

PCT Pub. Date: Apr. 18, 2019

(65) Prior Publication Data

US 2020/0340412 A1 Oct. 29, 2020

(30) Foreign Application Priority Data

Oct. 9, 2017 (FR) ..... 1759430

(51) Int. Cl.
*F02D 41/38* (2006.01)
*F02D 41/00* (2006.01)
*F02D 41/06* (2006.01)

(52) U.S. Cl.
CPC ..... *F02D 41/009* (2013.01); *F02D 41/3845* (2013.01); *F02D 41/062* (2013.01); (Continued)

(58) Field of Classification Search
CPC .. F02D 41/009; F02D 41/3845; F02D 41/062; F02D 41/22; F02D 2200/0604; (Continued)

(56) References Cited

FOREIGN PATENT DOCUMENTS

DE 19934112 A1 1/2001
DE 102013210178 A1 12/2014
(Continued)

OTHER PUBLICATIONS

International Search Report, dated Dec. 17, 2018, from corresponding PCT application No. PCT/FR2018/052471.

*Primary Examiner* — Hai H Huynh
(74) *Attorney, Agent, or Firm* — Nixon & Vanderhye

(57) ABSTRACT

Disclosed is a method for detecting the direction of rotation of a crankshaft of an engine of a motor vehicle. The detection method includes in particular, when the crankshaft is in a second predetermined angular position between a low angular position and a high angular position of the crankshaft, a step of commanding the closure of a control valve for the intake of fuel into the high-pressure pump, a step of measuring a second pressure value in the high-pressure rail, and a step of detecting a nominal direction of rotation of the crankshaft if the second pressure value measured is greater than or equal to an expected pressure value or of detecting a reverse direction of rotation of the crankshaft if the second pressure value measured is less than the expected pressure value.

20 Claims, 5 Drawing Sheets

(52) U.S. Cl.
CPC ..... *F02D 2200/0604* (2013.01); *F02D 2200/0614* (2013.01); *F02D 2250/06* (2013.01)

(58) Field of Classification Search
CPC ..... F02D 2200/0614; F02D 2200/0602; F02D 2250/06; F02D 2041/0095; F02D 2041/0092
USPC ..... 123/446, 456, 457, 495, 510, 511; 701/103–105; 73/114.41, 114.42, 114.43
See application file for complete search history.

(56) References Cited

FOREIGN PATENT DOCUMENTS

| | | | |
|---|---|---|---|
| WO | 90/03508 | A1 | 4/1990 |
| WO | 2016/165829 | A1 | 10/2016 |

DETECTION OF THE DIRECTION OF ROTATION OF A VEHICLE ENGINE

BACKGROUND OF THE INVENTION

Field of the Invention

The invention relates to the field of the rotation of a combustion engine and concerns more precisely a method and a system for detecting the direction of rotation of a combustion engine in order to limit the injection of fuel into the cylinders of the engine when the engine is rotating in a reverse direction.

The invention aims in particular to detect the direction of rotation of a combustion engine of a vehicle by detecting the direction of rotation of the crankshaft of said engine, when such a crankshaft is not equipped with a bidirectional position sensor and the position sensor of the camshaft is defective or does not exist. The invention aims notably to limit the risks of damage to the flywheels of the engine.

Description of the Related Art

As is known, a combustion engine of a motor vehicle has hollow cylinders that each delimit a combustion chamber into which a fuel-air mixture is injected. This mixture is compressed in the cylinder by a piston and ignited so as to make the piston move in translation inside the cylinder. The movement of the pistons in each cylinder of the engine causes a drive shaft known as the "crankshaft" to rotate, making it possible, via a transmission system, to drive the wheels of the vehicle in rotation. Specifically, such a crankshaft is connected to one or more flywheel(s), configured to store and release the kinetic energy resulting from their rotation.

More specifically, a four-stroke engine successively comprises, for each cylinder, four operating phases: a phase for the intake of air and fuel into the combustion chamber of the cylinder, a phase of compressing the mixture obtained, at the end of which it will be combusted, a phase of expanding the gases resulting from the combustion of the mixture, generating the thrust of the piston, and a phase of exhausting the gases from the combustion chamber.

The air of the mixture is injected into the combustion chamber via one or more intake valves, which are regularly open (during the intake phase) and closed (during the other phases). Similarly, the gases resulting from the air-fuel mixture are expelled during the exhaust phase through one or more exhaust valves. As is known, the opening and closure of these valves are effected by means of one or more camshaft(s). More specifically, the valves are connected to one or more camshafts for synchronizing the movement of the valves in order to successively effect the opening and closure thereof. The angular position of each of the cams on the camshaft is predetermined, allowing the operation of the combustion chambers in a synchronized manner. More specifically, since each cam of the camshaft comprises a predetermined number of lobes, this makes it possible, by rotation, to successively actuate the opening and closure of each intake valve.

In order to allow them to be set in rotation simultaneously, the crankshaft and the camshaft are connected, for example by a belt. When the vehicle is moving, that is to say when the engine is operating, the crankshaft and the camshaft rotate on themselves so as to drive both the successive thrust of each piston in the cylinders and the opening or closure of the intake and exhaust valves. When the engine is operating, the engine is then commonly referred to as turning. Such a rotation of the engine, and thus of each element of the engine (crankshaft, camshaft), is defined by a nominal direction of rotation and a reverse direction of rotation.

When the engine is operating, each element of the engine turns in a nominal direction, allowing proper operation of the engine and the forward movement of the vehicle. However, when the engine speed is low (known as "idling"), for example less than 1200 rpm, the rotation of the engine can in certain cases be temporarily reversed.

Specifically, by way of example, when a vehicle is being started up, the engine initially operates via the starter, and the engine speed is then around 300 rpm (revolutions per minute). If the torque generated by the combustion of the fuel is not sufficient to start the engine, the latter stalls, causing the engine to bounce back. Specifically, since the rotating flywheels have stored kinetic energy, the abrupt stopping of the engine does not allow them to dissipate the stored energy, thus causing the bounce-back effect. According to another example, which is illustrated in FIG. 1, if the vehicle is close to stopping and the engine does not stall, the engine speed (rpm) drops gradually over time (t) until the rotation of the elements of the engine stops completely (curve A). By contrast, if the engine stalls, it is subject to bounce-back, indicated by a temporary reversal of its rotation (curve B).

Such a reversal in the direction of rotation of the elements of an engine can cause damage to the flywheels connected to the crankshaft and thus cause the engine to break down. Thus, it is appropriate to detect the direction of rotation of the elements of the engine by determining the position of said elements, in order to forestall a reverse direction of rotation.

As is known, the position of the crankshaft is determined by means of a sensor for measuring the angular position of the crankshaft over a range of between 0° and 360°. To this end, the crankshaft comprises a toothed wheel having a predetermined number of regularly spaced-apart teeth, and also a tooth-free space corresponding to a position known as the "reference" position of the crankshaft. When the crankshaft is driven in rotation, the sensor, which is mounted next to such a toothed wheel, is configured to regularly transmit a signal representing the detection of a tooth to a computer of the vehicle. When the sensor is located opposite the tooth-free space, it does not transmit a signal to the computer, which then determines the reference position of the crankshaft when a signal representing the presence of a tooth is not transmitted for a predetermined period of time.

According to the prior art, some crankshafts are equipped with a bidirectional position sensor, which is configured to allow the position of the crankshaft to be determined regardless of its direction of rotation. Such a sensor therefore makes it possible to directly detect a reverse direction of rotation of the crankshaft. However, such a sensor is expensive and requires particular technology, which is not appropriate for all vehicle engines.

When the crankshaft does not comprise a bidirectional sensor, the direction of rotation of the crankshaft can be determined, in a known way, by means of a position sensor linked to the camshaft. Specifically, the angular position of the camshaft can be determined by means of a toothed wheel mounted on said camshaft and of a camshaft sensor disposed next to said toothed wheel. Such a camshaft toothed wheel comprises, in a known way, a succession of teeth with predetermined widths and spacings. Specifically, with reference to FIG. 2, a camshaft toothed wheel 151 comprises a plurality of teeth, for example four teeth T, U, V, W, with different predetermined widths, the spacing between each tooth T, U, V, W likewise being predetermined. Such distinct widths of teeth T, U, V, W make it possible, by means of the camshaft sensor, to know at any time the position of the toothed wheel 151 and thus the position of the camshaft. Since the latter is connected to the crankshaft 13, the detection of the position of the camshaft makes it possible to determine, at any time, the position of the crankshaft 13 in order to detect a reverse rotation of the crankshaft 13. However, such a camshaft sensor is expensive and, as a result, is not installed as standard on an engine. Moreover, when such a camshaft sensor is present, it may be defective. Thus, if the camshaft sensor is absent or defective and there is no bidirectional crankshaft sensor, the direction of rotation of the engine elements cannot be determined, and this represents a drawback.

SUMMARY OF THE INVENTION

Therefore, the aim of the invention is to remedy these drawbacks by proposing a simple, reliable and effective solution for determining the direction of rotation of the crankshaft of a motor vehicle engine, notably if there is no bidirectional crankshaft sensor and if a camshaft sensor is absent or defective, without injecting fuel into the cylinders.

In particular, the aim of the invention is to avoid damage to the flywheels on account of a reverse rotation of the engine, while limiting the level of pollution of such an engine.

To this end, a first subject of the invention is a method for detecting the direction of rotation of a crankshaft of a combustion engine of a motor vehicle, said vehicle comprising a combustion engine, having a plurality of cylinders, an injection module and a control module, said injection module comprising a high-pressure rail for injecting fuel into said cylinders, a high-pressure hydraulic pump that is able to pump fuel into said high-pressure rail, a control valve for the intake of fuel into said high-pressure pump controlled by said control module, a sensor for measuring the pressure in said high-pressure rail, said high-pressure pump comprising at least one piston for pumping the fuel, said piston being configured to slide in said high-pressure pump between a top dead center position and a bottom dead center position, said engine also comprising a crankshaft, characterized by its angular position defined on the basis of a reference position, and a sensor for measuring said angular position of the crankshaft, said crankshaft being characterized by a nominal direction of rotation, a reverse direction of rotation, an angular position known as the "low" angular position, corresponding to the bottom dead center position of the pumping piston, and an angular position known as the "high" angular position, corresponding to the top dead center position of the pumping piston. Said method is notable in that it comprises the steps of:

- detecting the reference position of the crankshaft,
- determining, using the control module, on the basis of the detected reference position of the crankshaft, the low angular position and the high angular position of the crankshaft,
- detecting said determined low angular position,
- when the crankshaft is in a first predetermined angular position, between the low angular position and the high angular position, commanding the closure of the control valve of the high-pressure pump and measuring a first pressure value in the high-pressure rail,
- when the crankshaft is in a second predetermined angular position between the first angular position and the high angular position, commanding the closure of the control valve of the high-pressure pump and measuring a second pressure value in the high-pressure rail, and
- detecting a nominal direction of rotation of the crankshaft if the second pressure value measured is greater than or equal to an expected predetermined pressure value, depending on the first pressure value, or detecting a reverse direction of rotation of the crankshaft if the second pressure value measured is less than said expected predetermined pressure value.

The method according to the invention advantageously makes it possible to detect a reverse direction of rotation of the crankshaft, making it possible to limit reverse rotation of the engine, advantageously limiting the risks of damage to the flywheels of the engine.

Such a method is preferably carried out for two angular positions of the crankshaft between a bottom dead center and a top dead center of the pumping piston, so as to monitor the change in pressure in the high-pressure rail and thus detect a fault in the change in such pressure, that is to say a change in pressure that is different from the change that would normally be observed if the crankshaft were turning in its nominal direction of rotation.

According to one aspect of the invention, the method also comprises a step of calculating the expected pressure value on the basis of the first pressure value.

According to one feature of the invention, the expected pressure value corresponds to the first pressure value measured at the first angular position of the crankshaft reduced by a first predetermined pressure variation, corresponding to the injection of fuel from the high-pressure rail into a cylinder of said plurality of cylinders, increased by a second predetermined pressure variation, corresponding to an addition of fuel from the high-pressure pump into the high-pressure rail. Such a calculation of the expected pressure value makes it possible to take into account the theoretical change in pressure in the high-pressure rail during nominal operation of the engine, during which a predetermined quantity of fuel is regularly added into the high-pressure rail and a predetermined quantity of fuel is regularly ejected from the high-pressure rail.

Preferably, the first angular position of the crankshaft corresponds to a first angle on the basis of the reference position of between 0° and 90°, preferably 90°, and the second angular position of the crankshaft corresponds to a second angle on the basis of the reference position of between 90° and 180°, preferably 180°, in the case of an engine comprising four cylinders and a high-pressure pump mounted on a cam comprising four lobes.

According to a preferred aspect of the invention, the engine is characterized by a rotational speed, said rotational speed being less than 1200 rpm, corresponding to a low rotational speed that is favorable to the occurrence of a reverse rotation of the engine.

Advantageously, with the position of the pumping piston being characterized by a plurality of bottom dead centers and a plurality of top dead centers, each top dead center following a bottom dead center, each step is repeated for a position of the pumping piston from and including each bottom dead center up to and excluding said following top dead center, so as to realize the method regularly between each bottom dead center and each top dead center.

Preferably, each step is repeated every 360° of the angular position of the crankshaft.

Alternatively, each step is repeated every 50 milliseconds.

Preferably, the control valve is a digital valve.

A further subject of the invention is a system for detecting the direction of rotation of a crankshaft of a combustion engine of a motor vehicle, comprising:

a combustion engine comprising:

a plurality of cylinders, a crankshaft, characterized by its angular position (θ) defined on the basis of a reference position ($D_0$), and a sensor (16) for measuring said angular position (θ) of the crankshaft, an injection module comprising:

a high-pressure rail for injecting fuel into said cylinders, a high-pressure hydraulic pump that is able to pump fuel into said high-pressure rail, said high-pressure pump comprising at least one piston for pumping the fuel, said piston being configured to slide in said high-pressure pump between a top dead center position and a bottom dead center position, said crankshaft being characterized by a nominal direction of rotation, a reverse direction of rotation, an angular position known as the "low" angular position, corresponding to the bottom dead center position of the pumping piston, and an angular position known as the "high" angular position, corresponding to the top dead center position of the pumping piston, a control valve for the intake of fuel into said high-pressure pump, and a sensor for measuring the pressure in said high-pressure rail, and a control module configured to:

command the opening and/or closure of said control valve, determine a low angular position and a high angular position of the crankshaft, determine an expected pressure value in the high-pressure rail, receive and store a measured pressure value, and determine the direction of rotation of the crankshaft by comparing said expected pressure value and said stored pressure value, measured in the high-pressure rail, in order to detect reverse rotation of the engine.

Preferably, the control valve is a digital valve.

Finally, the invention relates to a motor vehicle comprising a combustion engine and a system for detecting the direction of rotation of said engine as described above.

DESCRIPTION OF THE PREFERRED EMBODIMENTS

The invention will be presented below for the purpose of implementation in a motor vehicle. However, any implementation in a different context, in particular for any vehicle comprising a combustion engine of which it is necessary to determine the direction of rotation is also targeted by the present invention.

1/System 1

Figure 1:
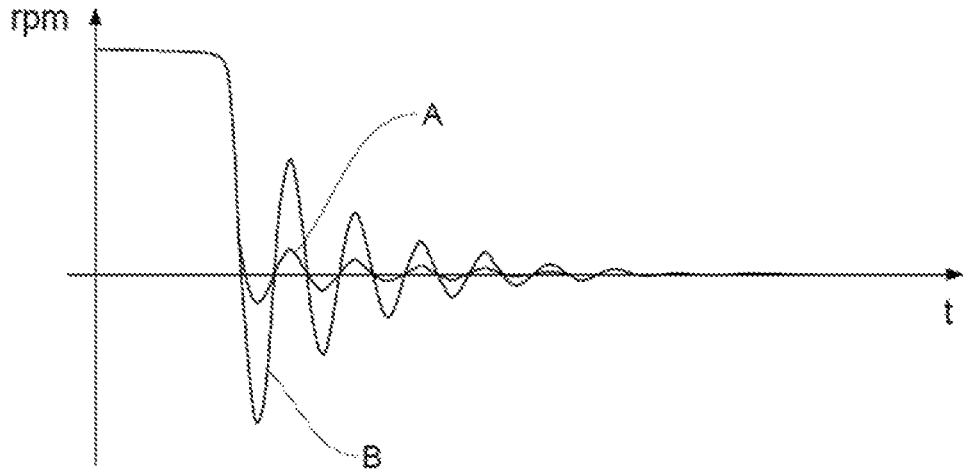
FIG. 1 schematically illustrates the change over time of the rotational speed of a combustion engine during a conventional stop and during stalling of the engine, illustrating the reverse rotation of an engine.
Figure 2:
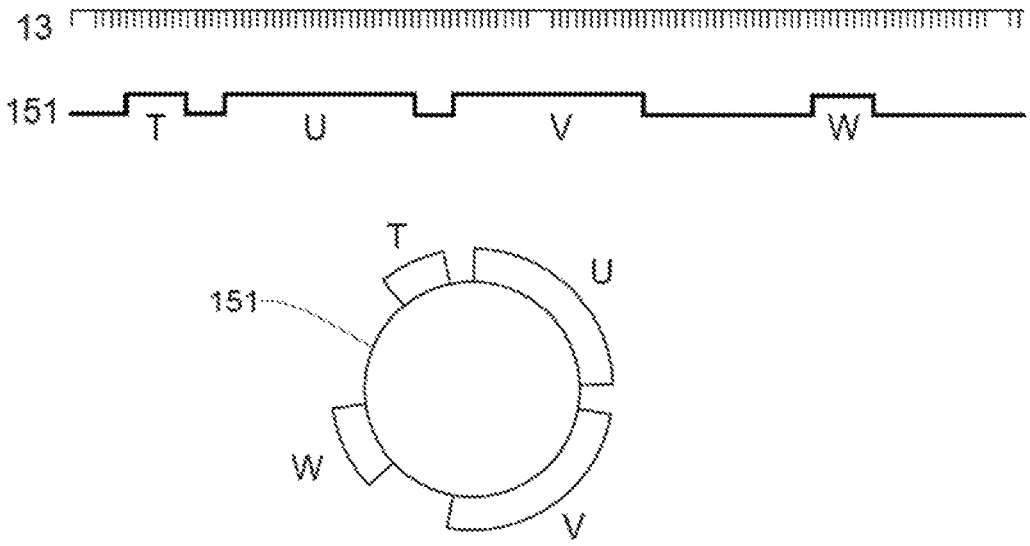
FIG. 2 schematically shows a camshaft toothed wheel and illustrates the determination of the position of a crankshaft on the basis of a camshaft sensor according to the prior art.
Figure 3:
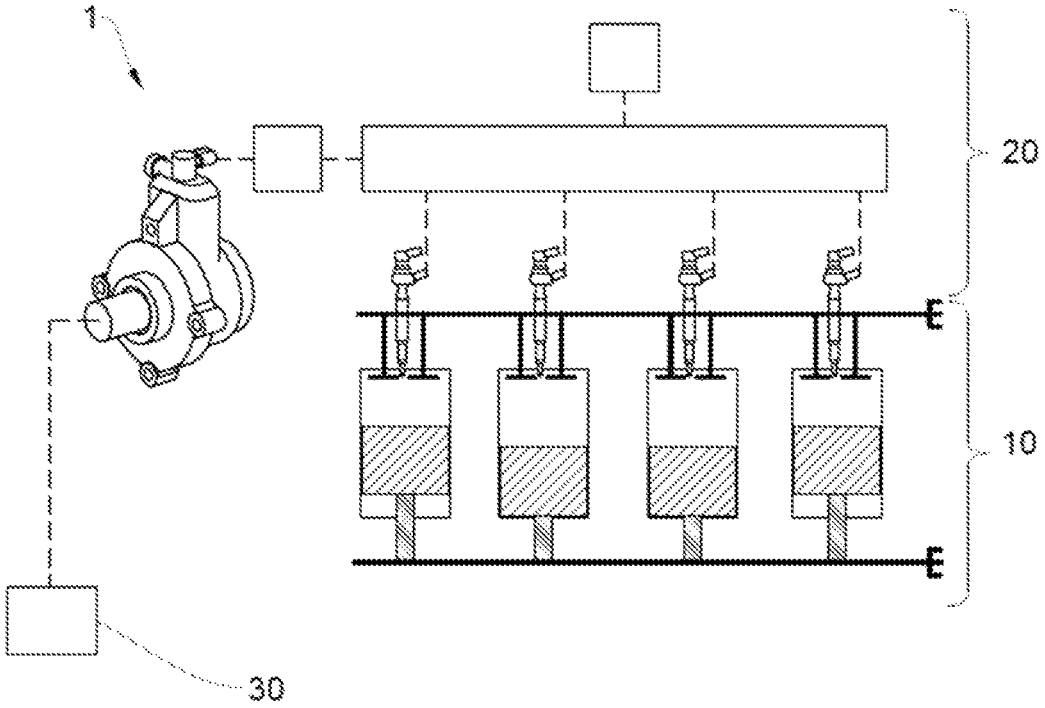
FIG. 3 schematically illustrates one embodiment of the system according to the invention.

With reference to FIG. 3, the system 1, according to one embodiment of the invention, comprises a motor vehicle combustion engine 10, an injection module 20 and a control module 30 of the injection module 20.

a. Engine 10

Figure 4:
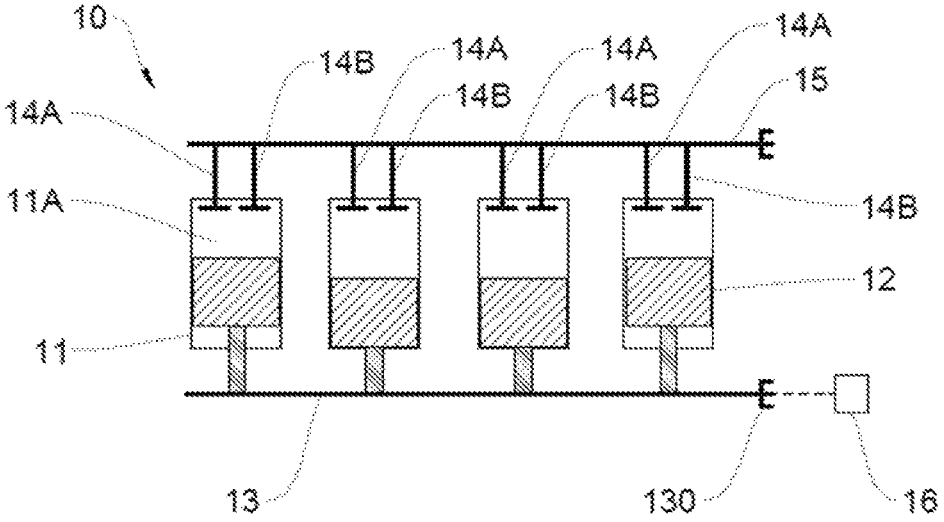
FIG. 4 is a schematic view of the system in FIG. 3, detailing the engine of the vehicle.

As shown schematically in FIG. 4, the combustion engine 10 comprises, in a known way, a plurality of cylinders 11 that each delimit a combustion chamber 11A in which a piston 12 slides, the movement of which is driven by compression and expansion of the gases resulting from the compression of a fuel-air mixture introduced into the combustion chambers 11A.

As a reminder, the air and the gases are introduced and expelled respectively via intake valves 14A and exhaust valves 14B, which are connected, in this example, to a single camshaft 15. However the engine 10 of the vehicle could just as easily comprise two camshafts 15, one dedicated to the intake valves 14A and the second to the exhaust valves 14B. Similarly, in this example, each cylinder 11 is connected to an intake valve 14A and an exhaust valve 14B; however, each cylinder 11 could equally be connected to a plurality of intake valves 14A and a plurality of exhaust valves 14B. The camshaft 15, which is set in rotation, makes it possible to alternately open and close the intake valve 14A and exhaust valve 14B of each combustion chamber 11A.

The set of pistons 12 is connected to a crankshaft 13, the setting in rotation of which by the thrust of each piston 12 allows the storage of kinetic energy by a flywheel (not shown), driving the rotation of the wheels of a vehicle. The crankshaft 13 comprises a toothed wheel 130 having a predetermined number of regularly spaced-apart teeth, and also a tooth-free space corresponding to a reference position $D_0$ of the crankshaft 13. Since such a toothed wheel 130 is known per se, it will not be described in more detail here.

A position sensor 16 is mounted next to the toothed wheel 130 so as to allow the detection of the reference position $D_0$ and the counting of the number of teeth passing in front of the position sensor 16 from the reference position $D_0$ by the control module 30 when the crankshaft 13 is driven in rotation. More specifically, the position sensor 16 provides a signal representing the passage of the teeth, allowing the control module 30 to determine the angular position θ from 0° to 360° of the crankshaft 13. As a variant, the position sensor 16 could itself detect the reference position $D_0$, count the teeth and send this information to the control module 30 without this limiting the scope of the present invention.

In order to allow the operation of the engine 10, each element of such an engine 10, namely the camshaft 15 and the crankshaft 13 for example, turn in a nominal direction of rotation.

b. Injection Module 20

The injection module 20 makes it possible to introduce the fuel into the combustion chambers 11A. For this purpose, the injection module 20 is connected to the control module 30, for example the main computer of the vehicle, and comprises, with reference to FIG. 5, a high-pressure pump 21, configured to pump the fuel into a high-pressure rail 22, connected to a plurality of injectors 23. The injection module 20 also comprises a control valve 24 for the intake of fuel into the high-pressure pump 21 and a pressure sensor 25.

Figure 6A:
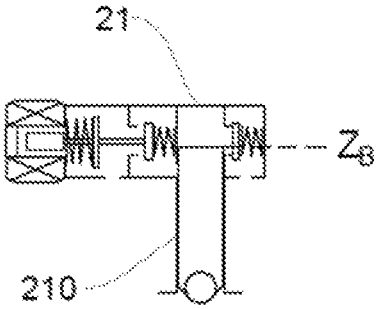
FIGS. 6A and 6B schematically illustrate a top dead center position and a bottom dead center position of a high-pressure pump piston.
Figure 6B:
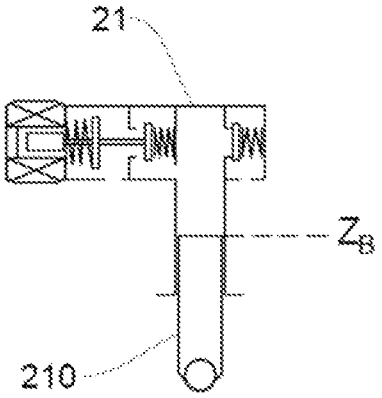

Preferably, the high-pressure pump 21 comprises an internal pumping piston 210 configured to control the flow rate of fuel, thereby regulating the pressure in the injection module 20. For this purpose, as shown in the example in FIGS. 6A and 6B, such a pumping piston 210 slides regularly in the high-pressure pump 21 between a high position, commonly known as "top dead center" $Z_H$, and a low position, commonly known as "bottom dead center" $Z_B$. In this example, the high-pressure pump 21 comprises a single pumping piston 210; however, it goes without saying that the high-pressure pump 21 could comprise a different number thereof, for example two pumping pistons 210.

Since the high-pressure pump 21 is mounted in a manner synchronized with the crankshaft 13, as described above, the bottom dead center $Z_B$ and the top dead center $Z_H$ of the pumping piston 210 correspond to angular positions $\theta_B$, $\theta_H$ of the crankshaft 13 that are known and determined by the control module 30 on the basis of the reference position $D_0$ detected by the position sensor 16. For the sake of clarity, such angular positions are referred to as "low angular position" $\theta_B$ and "high angular position" $\theta_H$, respectively, so as to allow quick and easy association between the positions of the pumping piston 210 and of the crankshaft 13.

The pumping piston 210 is thus configured to move regularly in the high-pressure pump 21 between the top dead center $Z_H$ and the bottom dead center $Z_B$, in order to allow the introduction of fuel into the high-pressure pump 21, and then the delivery thereof through a delivery circuit, when the control valve 24 is open.

Figure 7A:
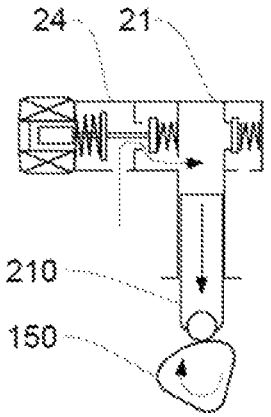
FIGS. 7A, 7B and 7C schematically illustrate an example of the operation of a piston pump actuated by a cam.
Figure 7C:
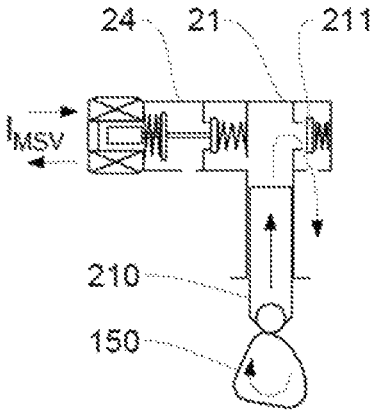
Figure 7B:
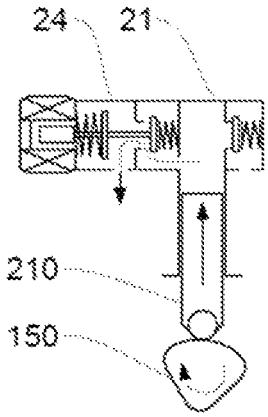

Specifically, as shown in FIGS. 7A, 7B and 7C, the fuel is introduced into the high-pressure pump 21 via a control valve 24, which, depending on its open or closed state, allows the intake of fuel into the high-pressure pump 21, thereby making it possible to control the flow rate of fuel. Thus, when the control valve 24 is open, as shown in FIGS. 7A and 7B, the movement of the pumping piston 210 causes the introduction and the delivery of fuel, without an increase in pressure in the high-pressure pump 21. However, when the control valve 24 is closed, as shown in FIG. 7C, the pumping piston 210, driven by a cam 150 of the camshaft 15, rises up to the top dead center ZH and compresses the fuel introduced into the high-pressure pump 21. The pressure rises, causing a shutter 211 for connecting to the high-pressure rail 22 to open, causing the introduction of fuel into the high-pressure rail 22 and thus the rise in pressure in the high-pressure rail 22.

Figure 5:
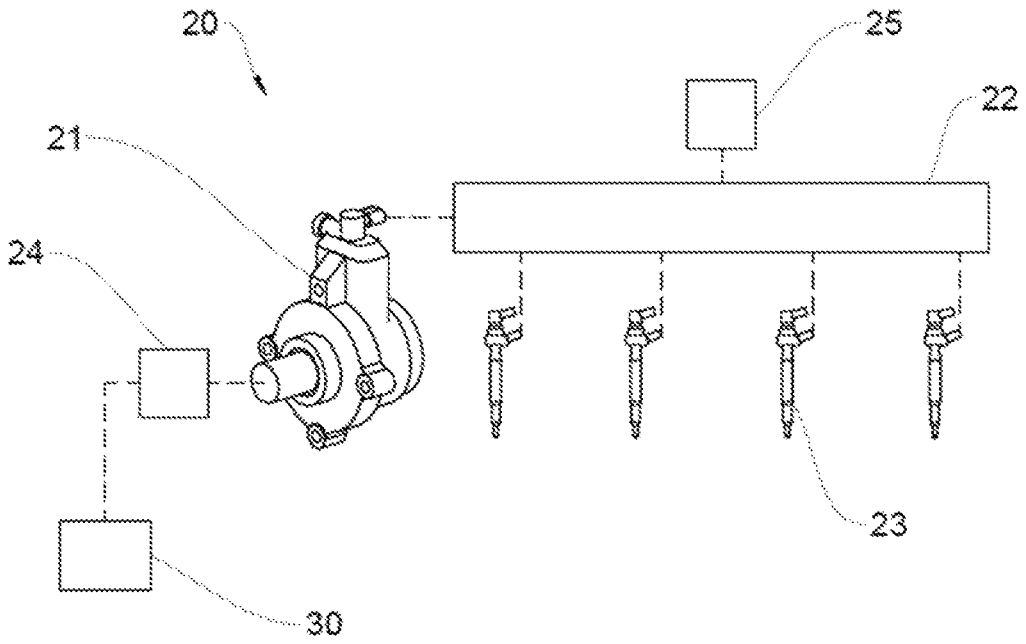
FIG. 5 is a schematic view of the system in FIG. 3, detailing the injection module.

Such a control valve 24 is preferably a digital flow valve, allowing more precise control of the flow rate of fuel in the high-pressure pump 21 and thus regulation of the pressure in the high-pressure rail 22. Moreover, in this example, the control valve 24 is included in the high-pressure pump 21; however, it goes without saying that the control valve 24 could be outside the high-pressure pump 21, as is shown in FIG. 5.

In particular, the high-pressure pump 21 is configured to rise in pressure, by means of the control valve 24, synchronously with one or more defined positions of the crankshaft 13, allowing a rise in pressure in the high-pressure rail 22.

Such a high-pressure rail 22 is configured to allow the distribution of the fuel, coming from the high-pressure pump 21, into the set of cylinders 11 of the engine 10 via injectors 23.

The injector 23 of the combustion chamber 11A of which the intake valve 14A is open is activated so as to allow, in this example, the simultaneous intake of the fuel-air mixture into the combustion chamber 11A.

In order to make it possible to implement the invention, the injection module 20 also comprises a pressure sensor 25, which is connected to the high-pressure rail 22 and configured to measure the pressure in the high-pressure rail 22.

In summary, during nominal operation of the engine 10 (i.e. In the nominal direction of rotation of the engine 10), the control valve 24 is configured to be regularly open and closed. Thus, when it is closed, the rise of the pumping piston 210 toward the top dead center $Z_H$ causes a rise in pressure in the high-pressure rail 22. The pumping piston 210 then drops toward the bottom dead center $Z_B$. The control valve 24 is open. The fuel is injected into one of the combustion chambers 11A by means of an injector 23, thereby lowering the pressure in the high-pressure rail 22. Then, the control valve 24 is closed again, causing the addition of fuel from the high-pressure pump 21 toward the high-pressure rail 22. The pressure increases again in the high-pressure rail 22. The engine 10 then turns in the nominal direction of rotation.

When the engine 10 turns in the reverse direction, that is to say when the direction of rotation of the crankshaft 13 is reversed, if the control valve 24 is closed and the pumping piston 210 rises toward the top dead center $Z_H$, introducing fuel into the high-pressure rail 22, causing the regular rise in pressure in the high-pressure rail 22 measured by the pressure sensor 25, the reversal of the direction of rotation of the crankshaft 13 causes the pumping piston 210 to drop. The fuel is then no longer added into the high-pressure rail 22 and the pressure stops increasing. The pressure sensor 25 then measures a pressure of fuel in the high-pressure rail 22 that is lower than the pressure that would have been measured if the engine 10 had functioned as per its nominal direction of rotation.

In this example, the pressure sensor 25 is configured to transmit the pressure measurement values to the control module 30.

c. Control Module 30

The control module 30, in this example the main computer of the vehicle, makes it possible to control injection of fuel so as to add fuel into a defined combustion chamber 11A at a precise moment. To this end, the computer is configured to manage the control valve 24 in order to control the flow rate of fuel in the high-pressure pump 21 and to command the closure of such a control valve 24 of the high-pressure pump 21, allowing the introduction of fuel into the high-pressure rail 22. In other words, the computer is configured to control the pumping of fuel in the high-pressure rail 22 via the high-pressure pump 21 controlled by the control valve 24 at a given moment corresponding to a predetermined angular position θ of the crankshaft 13 that is known and determined in advance.

Specifically, the control module 30 is configured to determine the angular position θ from 0° to 360° of the crankshaft on the basis of the reference position $D_0$ detected by the measuring sensor 16, allowing the control module 30 to determine each low angular position $\theta_B$ and each high angular position $\theta_H$ of the crankshaft 13 corresponding to the position of each bottom dead center $Z_B$ and of each top dead center $Z_H$ of the pumping piston 210 of the high-pressure pump 21, through which the pumping piston 210 would pass if the engine 10 were turning in the nominal direction of rotation.

The control module 30 is also configured to receive the data supplied by the position sensor 16 of the crankshaft 13 and by the pressure sensor 25 in the high-pressure rail 22 and to store the pressure values P received.

The control module 30 is thus configured to determine at any time an expected pressure value $P_A$, corresponding to the pressure value P that would be measured in the high-pressure rail 22, between a bottom dead center $Z_B$ and a top dead center $Z_H$ of the pumping piston 210, if the engine 10 were turning in its nominal direction of rotation at any time. In other words, the expected pressure value $P_A$ corresponds to the pressure value P prevailing in the high-pressure rail 22 when the pumping piston 210 rises at any time between a bottom dead center $Z_B$ and a top dead center $Z_H$.

Finally, the control module 30 is configured to compare each measured pressure value P with the expected pressure value $P_A$ and to determine if the crankshaft 13 is turning in a nominal direction of rotation or a reverse direction of rotation.

2/Method

The invention will now be described in an exemplary embodiment with reference to FIGS. 8 and 9. The method for determining the direction of rotation of the crankshaft 13 makes it possible to determine the direction of rotation of the engine 10.

In this example, the method first of all comprises a step E0 of starting up the engine 10, making it possible to set the crankshaft 13 in rotation.

Preferably, the engine 10 is characterized by a rotational speed, less than 1200 rpm (idling of the engine 10), corresponding to a low rotational speed favorable to the occurrence of a reverse rotation of the engine 10.

The position sensor 16 then detects, in a step E1, the reference position $D_0$ of the crankshaft 13, by detecting the tooth-free space on the toothed wheel 130. A detection signal of the reference position $D_0$ is then sent to the control module 30, in this example the main computer of the vehicle.

In this example, the position sensor 16 detects the reference position $D_0$ of the crankshaft 13 and transmits a detection signal of such a reference position $D_0$ to the control module 30. However, it goes without saying that the position sensor 16 could just as easily detect each tooth of the toothed wheel 130 and regularly transmit to the control module 30 a detection signal of the presence of a tooth, in which case the control module 30 would detect the reference position $D_0$ of the crankshaft 13 when no signal is sent by the position sensor 16 for a predetermined time for example.

Figure 8:
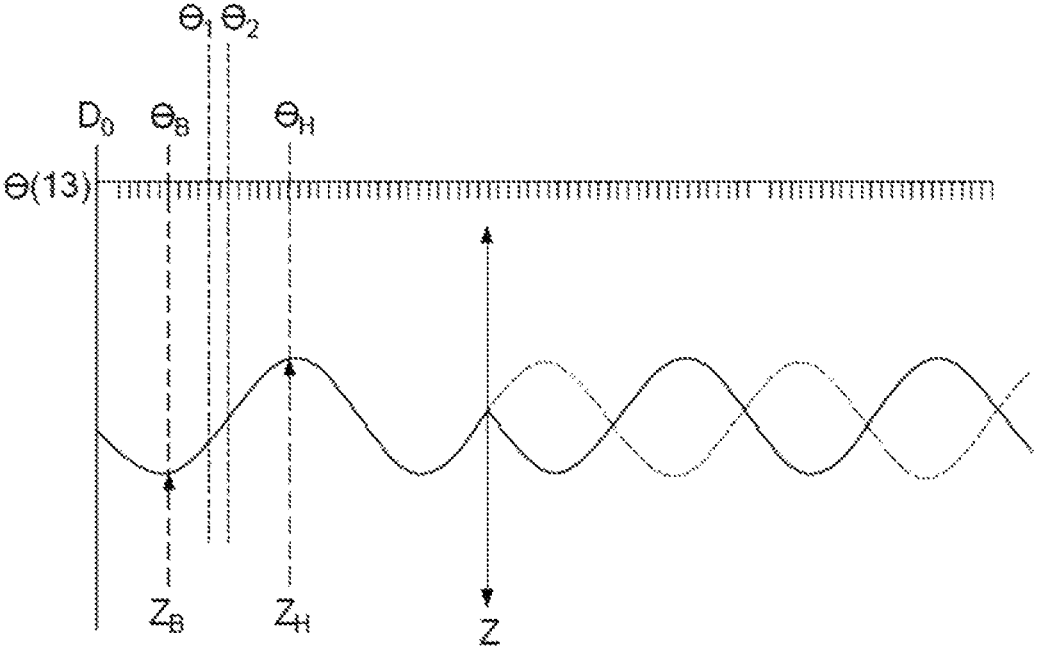
FIG. 8 illustrates in the form of a graph an example of the change in position of the pumping piston in the high-pressure pump depending on the position of the crankshaft.
Figure 9:
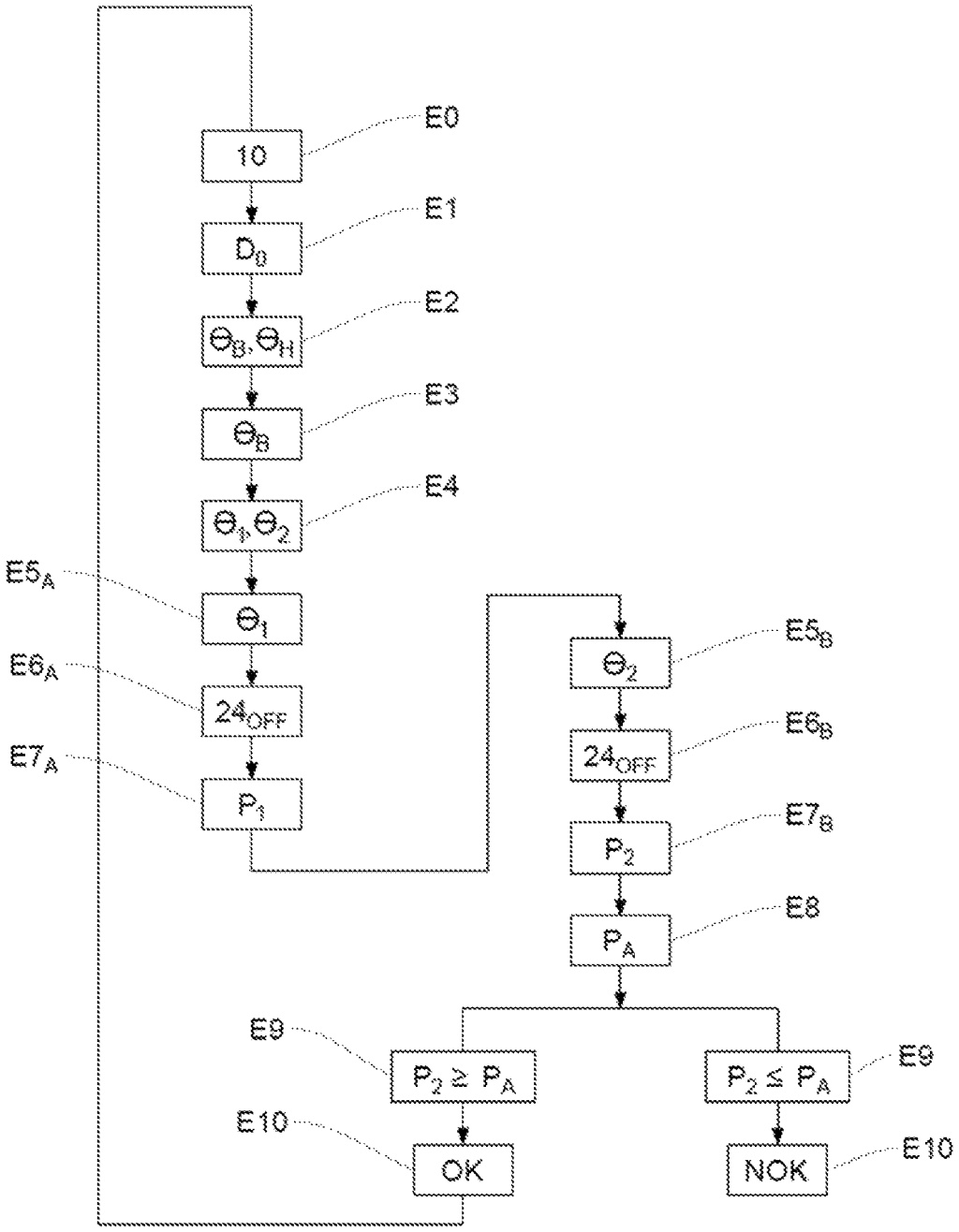
FIG. 9 schematically illustrates one embodiment of the method according to the invention.

When the control module 30 receives the information relating to detection of the reference position $D_0$ of the crankshaft 13, said control module 30 determines, in a step E2, the low angular position $\theta_B$ and the high angular position $\theta_H$ of the crankshaft 13 corresponding to the next bottom dead center $Z_B$ and the next top dead center $Z_H$, respectively, of the pumping piston 210 in the high-pressure pump 21 (when the engine 10 is turning in its nominal direction of rotation), as illustrated in FIG. 8. The method is then implemented preferably during a phase in which the pumping piston 210 rises in the high-pressure pump 21.

Following detection of the low angular position $\theta_B$ of the crankshaft 13, corresponding to the bottom dead center $Z_B$ of the pumping piston 210, in a step E3, the control module 30 determines, in a step E4, a first angular position $\theta_1$ of the crankshaft 13, corresponding to a first rotational angle on the basis of the reference position $D_0$, and a second angular position $\theta_2$ of the crankshaft 13, corresponding to a second rotational angle on the basis of the reference position $D_0$. In the example of an engine 10 comprising four cylinders 11 and a high-pressure pump 21 mounted on a cam 150 of the camshaft 15 comprising four lobes, the first rotational angle on the basis of the reference position $D_0$ is between 0 and 90°, preferably 90°, and the second rotational angle on the basis of the reference position $D_0$ is between 90 and 180°, preferably 180°.

When the crankshaft 13 is in the first angular position $\theta_1$, between the low angular position $\theta_B$ and the high angular position $\theta_H$, detected in a step E5$_A$, the control module 30 commands, in a step E6$_A$, the closure of the control valve 24 of the high-pressure pump 21, allowing the addition of fuel into the high-pressure rail 22 and thus an increase in the pressure in such a high-pressure rail 22.

In this example, the control module 30 detects the first angular position $\theta_1$ of the crankshaft 13 on the basis of the reference position $D_0$; however, the control module 30 could equally trigger a timeout, the duration of which corresponds to a predetermined period of time, for example 1 millisecond. This timeout corresponds to the time between the detection of the reference position $D_0$ and a first predetermined position of the pumping piston 210 rising in the high-pressure pump 21.

The pressure in the high-pressure rail 22 is measured in a step E7$_A$ by means of the pressure sensor 25. A first pressure value $P_1$ is then transmitted to the control module 30, which stores such a first value $P_1$.

The control module 30 then detects, in a step E5$_B$, the second angular position $\theta_2$ of the crankshaft 13, between the low angular position $\theta_B$ and the high angular position $\theta_H$ of the crankshaft 13 and strictly higher than the first angular position $\theta_1$ detected in step E6$_A$ or previously stored in the control module 30.

When the crankshaft 13 is in the second angular position $\theta_2$, the control module 30 commands, in a step E6$_B$, the closure of the control valve 24 of the high-pressure pump 21, allowing the addition of fuel into the high-pressure rail 22 and thus an increase in the pressure in such a high-pressure rail 22.

During nominal operation of the engine 10, if the crankshaft 13 is turning in its nominal direction of rotation, between the first angular position $\theta_1$ and the second angular position $\theta_2$, the high-pressure rail 22 may have injected fuel into one of the combustion chambers 11A by means of an injector 23. Such an injection corresponds to a volume of fuel representing a first variation in pressure $\Delta P_{11}$. In other words, between the first angular position $\theta_1$ and the second angular position $\theta_2$ of the crankshaft 13, the pressure in the high-pressure rail 22 has decreased by the first variation in pressure $\Delta P_{11}$ with respect to the first pressure value $P_1$ measured in step E5$_A$ or previously stored in the control module 30.

Similarly, if the crankshaft 13 is turning in its nominal direction of rotation, the pumping piston 210 has continued to rise between the first angular position $\theta_1$ and the second angular position $\theta_2$ of the crankshaft 13, causing the introduction of an additional volume of fuel into the high-pressure rail 22. Such an additional volume of fuel corresponds to an additional second variation in pressure $\Delta P_{21}$. Thus, the pressure in the high-pressure rail 22 has also increased by the second variation in pressure $\Delta P_{21}$ with respect to the first pressure value $P_1$.

In summary, between the first angular position $\theta_1$ and the second angular position $\theta_2$ of the crankshaft 13, if the engine 10 is turning in its nominal direction of rotation, the pressure value P in the high-pressure rail 22 is equal to: $P_1+\Delta P_{21}-\Delta P_{11}$, corresponding to an expected pressure value $P_A$ during the measurement of the pressure in the high-pressure rail 22 when the crankshaft 13 is in its second angular position $\theta_2$.

The pressure in the high-pressure rail 22 is then measured in a step E7$_B$ by means of the pressure sensor 25. A second pressure value $P_2$ is then transmitted to the control module 30.

The method then comprises a step E8 of calculation by the control module 30 of the expected pressure value $P_A$, corresponding to the minimum pressure value P that would be measured in the high-pressure rail 22 if the engine 10 were turning in its nominal direction of rotation.

The second pressure value $P_2$ measured in the high-pressure rail 22 is then compared, in a step E9, with the expected pressure value $P_A$ by the control module 30.

When the second measured pressure value $P_2$ is greater than or equal to the expected pressure value $P_A$, the method determines, in a step E10, that the crankshaft 13 is turning in its nominal direction of rotation. The engine 10 thus turns in its nominal direction of rotation OK.

When the second measured pressure value $P_2$ is less than the expected pressure value $P_A$, the method determines, in this same step E10, that the crankshaft 13 is turning in a reverse direction of rotation. The engine 10 thus turns in the reverse direction NOK.

The method according to the invention is preferably repeated at regular intervals, for example every 50 milliseconds, during the rising phase of the pumping piston 210 in the high-pressure pump 21 between the first bottom dead center $Z_B$ (included) and the first top dead center $Z_H$ (excluded). Such a method is then repeated for each interval between each bottom dead center $Z_B$ and each top dead center $Z_H$ of the pumping piston 210.

Such a method advantageously makes it possible to determine the direction of rotation of the crankshaft, thereby making it possible to detect reverse rotation of the engine, in particular if there is no bidirectional crankshaft sensor and if a camshaft sensor is absent or defective. The invention advantageously makes it possible to limit damage to the flywheels of such an engine.

The invention claimed is:

1. A method for detecting the direction of rotation of a crankshaft (13) of a combustion engine (10) of a motor vehicle, said vehicle comprising a combustion engine (10), having a plurality of cylinders (11), an injection module (20) and a control module (30), said injection module (20) comprising a high-pressure rail (22) for injecting fuel into said cylinders (11), a high-pressure hydraulic pump (21) that is able to pump fuel into said high-pressure rail (22), a control valve (24) for the intake of fuel into said high-pressure pump (21) controlled by said control module (30), a sensor (25) for measuring the pressure in said high-pressure rail (22), said high-pressure pump (21) comprising at least one piston (210) for pumping the fuel, said piston being configured to slide in said high-pressure pump (21) between a top dead center position ($Z_H$) and a bottom dead center position ($Z_B$), said engine (10) also comprising a crankshaft (13), with an angular position ($\theta$) defined on the basis of a reference position ($D_0$), and a sensor (16) for measuring said angular position ($\theta$) of the crankshaft (13), said crankshaft (13) having a nominal direction of rotation, a reverse direction of rotation, an angular position known as the "low" angular position ($\theta_B$), corresponding to the bottom dead center position ($Z_B$) of the pumping piston (210), and an angular position known as the "high" angular position ($\theta_B$), corresponding to the top dead center position ($Z_H$) of the pumping piston (210), said method comprising:

detecting (E1) the reference position ($D_0$) of the crankshaft (13), determining (E2), using the control module (30), on the basis of the detected reference position ($D_0$) of the crankshaft (13), the low angular position ($\theta_B$) and the high angular position ($\theta_B$) of the crankshaft (13), detecting (E3) said determined low angular position ($\theta_B$), when the crankshaft (13) is in a first predetermined angular position ($\theta_H$), between the low angular position ($\theta_B$) and the high angular position ($\theta_H$), commanding (E6$_A$) the closure of the control valve (24) of the high-pressure pump (21) and measuring (E7$_A$) a first pressure value ($P_1$) in the high-pressure rail (22), when the crankshaft (13) is in a second predetermined angular position ($\theta_2$) between the first angular position ($\theta_1$) and the high angular position ($\theta_H$), commanding (E6$_B$) the closure of the control valve (24) of the high-pressure pump (21) and measuring (E7$_B$) a second pressure value ($P_2$) in the high-pressure rail (22), and detecting (E10) a nominal direction of rotation of the crankshaft (13) if the second pressure value ($P_2$) measured is greater than or equal to an expected predetermined pressure value ($P_A$), dependent on the first pressure value ($P_1$), or detecting (E10) a reverse direction of rotation of the crankshaft (13) if the second pressure value ($P_2$) measured is less than said expected predetermined pressure value ($P_A$).

2. The method as claimed in claim 1, also comprising a step of calculating (E8) the expected pressure value ($P_A$) on the basis of the first pressure value ($P_1$).

3. The method as claimed in either claim 2, wherein the expected pressure value ($P_A$) corresponds to the first pressure value ($P_1$) measured at the first angular position ($\theta_1$) of the crankshaft (13) reduced by a first predetermined pressure variation ($\Delta P_{11}$), corresponding to the injection of fuel from the high-pressure rail (22) into a cylinder (11) of said plurality of cylinders (11), increased by a second predetermined pressure variation ($\Delta P_{21}$), corresponding to an addition of fuel from the high-pressure pump (21) into the high-pressure rail (22).

4. The method as claimed in claim 2, wherein, with the engine (10) having a rotational speed, said rotational speed is less than 1200 rpm.

5. The method as claimed in claim 2, wherein, with the position of the pumping piston (210) having a plurality of bottom dead centers ($Z_B$) and a plurality of top dead centers ($Z_H$), each top dead center ($Z_H$) following a bottom dead center ($Z_B$), each step is repeated for a position of the pumping piston (210) from and including each bottom dead center ($Z_B$) up to and excluding said following top dead center ($Z_H$).

6. The method as claimed in either claim 1, wherein the expected pressure value ($P_A$) corresponds to the first pressure value ($P_1$) measured at the first angular position ($\theta_1$) of the crankshaft (13) reduced by a first predetermined pressure variation ($\Delta P_{11}$), corresponding to the injection of fuel from the high-pressure rail (22) into a cylinder (11) of said plurality of cylinders (11), increased by a second predetermined pressure variation ($\Delta P_{21}$), corresponding to an addition of fuel from the high-pressure pump (21) into the high-pressure rail (22).

7. The method as claimed in claim 6, wherein, with the engine (10) having a rotational speed, said rotational speed is less than 1200 rpm.

8. The method as claimed in claim 6, wherein, with the position of the pumping piston (210) having a plurality of bottom dead centers ($Z_B$) and a plurality of top dead centers ($Z_H$), each top dead center ($Z_H$) following a bottom dead center ($Z_B$), each step is repeated for a position of the pumping piston (210) from and including each bottom dead center ($Z_B$) up to and excluding said following top dead center ($Z_H$).

9. The method as claimed in claim 1, wherein the first angular position ($\theta_1$) of the crankshaft (13) corresponds to a first angle on the basis of the reference position ($D_0$) of between 0° and 90°, and the second angular position ($\theta_2$) of the crankshaft (13) corresponds to a second angle on the basis of the reference position ($D_0$) of between 90° and 180°, in the case of an engine (10) comprising four cylinders (11) and a high-pressure pump (21) mounted on a cam (150) comprising four lobes.

10. The method as claimed in claim 9, wherein, with the engine (10) having a rotational speed, said rotational speed is less than 1200 rpm.

11. The method as claimed in claim 9, wherein, with the position of the pumping piston (210) having a plurality of bottom dead centers ($Z_B$) and a plurality of top dead centers ($Z_H$), each top dead center ($Z_H$) following a bottom dead center ($Z_B$), each step is repeated for a position of the pumping piston (210) from and including each bottom dead center ($Z_B$) up to and excluding said following top dead center ($Z_H$).

12. The method as claimed in claim 1, wherein, with the engine (10) having a rotational speed, said rotational speed is less than 1200 rpm.

13. The method as claimed in claim 12, wherein, with the position of the pumping piston (210) having a plurality of bottom dead centers ($Z_B$) and a plurality of top dead centers ($Z_H$), each top dead center ($Z_H$) following a bottom dead center ($Z_B$), each step is repeated for a position of the pumping piston (210) from and including each bottom dead center ($Z_B$) up to and excluding said following top dead center ($Z_H$).

14. The method as claimed in claim 1, wherein, with the position of the pumping piston (210) having a plurality of bottom dead centers ($Z_B$) and a plurality of top dead centers ($Z_H$), each top dead center ($Z_H$) following a bottom dead center ($Z_B$), each step is repeated for a position of the pumping piston (210) from and including each bottom dead center ($Z_B$) up to and excluding said following top dead center ($Z_H$).

15. The method as claimed in claim 1, wherein each step is repeated every 360° of the angular position of the crankshaft (13).

16. The method as claimed in claim 1, wherein each step is repeated every 50 milliseconds.

17. The method as claimed in claim 1, wherein the first angular position ($\theta_1$) of the crankshaft (13) corresponds to a first angle on the basis of the reference position ($D_0$) of 90°, and the second angular position ($\theta_2$) of the crankshaft (13) corresponds to a second angle on the basis of the reference position ($D_0$) of between 90° and 180°, in the case of an engine (10) comprising four cylinders (11) and a high-pressure pump (21) mounted on a cam (150) comprising four lobes.

18. The method as claimed in claim 17, wherein the second angular position ($\theta_2$) of the crankshaft (13) corresponds to a second angle on the basis of the reference position ($D_0$) of 180°, in the case of an engine (10) comprising four cylinders (11) and a high-pressure pump (21) mounted on a cam (150) comprising four lobes.

19. A system (1) for detecting the direction of rotation of a crankshaft (13) of a combustion engine (10) of a motor vehicle, comprising:

- a combustion engine (10) comprising:
  - a plurality of cylinders (11),
  - a crankshaft (13), having an angular position ($\theta$) defined on the basis of a reference position ($D_0$), and
  - a sensor (16) for measuring said angular position ($\theta$) of the crankshaft (13),
- an injection module (20) comprising:
  - a high-pressure rail (22) for injecting fuel into said cylinders (11),
  - a high-pressure hydraulic pump (21) that is able to pump fuel into said high-pressure rail (22), said high-pressure pump (21) comprising at least one piston (210) for pumping the fuel, said piston being configured to slide in said high-pressure pump (21) between a top dead center position ($Z_H$) and a bottom dead center position ($Z_B$), said crankshaft (13) having a nominal direction of rotation, a reverse direction of rotation, an angular position known as the "low" angular position ($\theta_B$), corresponding to the bottom dead center position ($Z_B$) of the pumping piston (210), and an angular position known as the "high" angular position ($\theta_H$), corresponding to the top dead center position ($Z_H$) of the pumping piston (210),
  - a control valve (24) for the intake of fuel into said high-pressure pump (21), and
  - a sensor (25) for measuring the pressure in said high-pressure rail (22), and
- a control module (30) configured to:
  - command the opening and/or closure of said control valve (24),
  - determine a low angular position ($\theta_B$) and a high angular position ($\theta_H$) of the crankshaft (13),
  - determine an expected pressure value ($P_A$) in the high-pressure rail (22),
  - receive and store a measured pressure value (P), and
  - determine the direction of rotation of the crankshaft (13) by comparing said expected pressure value ($P_A$) and said stored pressure value (P), measured in the high-pressure rail (22), in order to detect reverse rotation of the engine (10).

20. A motor vehicle comprising a combustion engine (10) and a system (1) for detecting the direction of rotation of said engine (10) as claimed in claim 19.

* * * * *